US007282633B1

(12) United States Patent
Coolidge

(10) Patent No.: US 7,282,633 B1
(45) Date of Patent: Oct. 16, 2007

(54) SOUND AUGMENTATION SYSTEM AND METHOD FOR A DRUM

(76) Inventor: Curtis J. Coolidge, 13100 Larsen St., Overland Park, KS (US) 66213

( * ) Notice: Subject to any disclaimer, the term of this patent is extended or adjusted under 35 U.S.C. 154(b) by 153 days.

(21) Appl. No.: 11/082,377

(22) Filed: Mar. 17, 2005

Related U.S. Application Data

(60) Provisional application No. 60/554,967, filed on Mar. 18, 2004.

(51) Int. Cl.
*G10H 3/00* (2006.01)

(52) U.S. Cl. ..... 84/723; 84/600; 84/730; 84/411 R; 84/104

(58) Field of Classification Search ..... None
See application file for complete search history.

(56) References Cited

U.S. PATENT DOCUMENTS

| | | | | |
|---|---|---|---|---|
| 3,553,339 | A | 1/1971 | Dominguez | |
| 3,659,032 | A | 4/1972 | May | |
| 4,168,646 | A | 9/1979 | May | |
| 4,570,522 | A | 2/1986 | May | |
| 4,741,242 | A * | 5/1988 | Aronstein | 84/454 |
| 5,042,356 | A | 8/1991 | Karch | |
| 5,293,000 | A | 3/1994 | Adinolfi | |
| 5,430,245 | A * | 7/1995 | Rogers | 84/725 |
| 6,121,528 | A | 9/2000 | May | |
| 6,121,538 | A * | 9/2000 | Yoshino et al. | 84/738 |
| 6,982,376 | B2 * | 1/2006 | Wise | 84/600 |
| 2003/0061932 | A1 * | 4/2003 | Tanaka et al. | 84/734 |
| 2004/0060427 | A1 | 4/2004 | Franco | |

* cited by examiner

*Primary Examiner*—Marlon Fletcher
(74) *Attorney, Agent, or Firm*—Mark C. Young; Stinson Morrison Hecker LLP

(57) ABSTRACT

A sound augmentation system for a drum comprises a wave generator for producing an electrical signal corresponding to a predetermined sound, an amplifier for amplifying the electrical signal to produce an amplified electrical signal, and a driver for translating the amplified electrical signal to a plurality of sound waves. The wave generator, amplifier and driver are mounted to a support structure configured to fit within a body of the drum. In operation, a strike of the head of the drum produces amplified sound waves that emanate from the body of the drum. Various embodiments of the sound augmentation system and associated method are provided.

31 Claims, 4 Drawing Sheets

SOUND AUGMENTATION SYSTEM AND METHOD FOR A DRUM

CROSS-REFERENCE TO RELATED APPLICATIONS

This application claims priority to U.S. Provisional Application Ser. No. 60/554,967 filed on Mar. 18, 2004, which is hereby incorporated by reference herein in its entirety.

STATEMENT REGARDING FEDERALLY SPONSORED RESEARCH OR DEVELOPMENT

Not applicable.

BACKGROUND OF THE INVENTION

1. Field of the Invention

The present invention relates to musical instrument sound producing devices, and more particularly to a sound augmentation system for use with a drum.

2. Description of Related Art

Electrical and electronic amplifiers are commonly used in the music industry to provide proper sound volume throughout the venue in which musicians, bands or other performers play. Large arenas typically require massive amplifiers and speakers to fill the venue with sound, while smaller clubs require correspondingly smaller amplifiers and speakers.

Small clubs, however, present challenges in providing a proper mix of amplification of the various instruments. Electric instruments, such as electric guitars, electronic keyboards, and electric bass guitars, require amplification in order to produce any perceptible volume. Vocals and acoustic instruments, such as acoustic guitars, can be amplified using microphones routed to amplifiers to raise their volume level to that of the electric instruments. Thus, the relative volume of each instrument or vocal can be adjusted by simply varying the volume of the amplifier for that instrument.

Drums, however, present a unique challenge in a small club setting. While the volume and relatively high frequency of the tom drums is typically sufficient to be discerned clearly without amplification, the lower frequency of the bass, or kick, drum can be easily lost beneath the multi-frequency, higher volume mix of the other instruments. The loss of definition of the kick drum is particularly pronounced when an electric bass guitar is being used. The amplified low frequency of the bass guitar tends to drown out the kick drum, making it less noticeable than the other amplified instruments and vocals.

Various ways to alleviate this problem have been proposed and attempted, but each suffers from its own drawbacks. One proposed solution is to provide a microphone and amplifier to detect and amplify the sound emanating from the kick drum. This requires placing a microphone on the front side of the drum, opposite the drummer, and running cable from the microphone to a remote amplifier and speaker. This method is often used in large venues, where space is not an issue. In small venues, however, it is not always possible to place a microphone and an additional large amplifier and speaker where it does not interfere with or take space from the rest of the stage.

Additionally, in a small venue, a remotely located amplifier and speaker distort the apparent spatial location of the drum since the amplified drum sound does not emanate from the area of the kick drum. Furthermore, available amplifiers and speakers capable of properly reproducing the low frequency kick drum signal are intended for larger venues, and are thus more expensive and bulky, prohibiting their use in small venues.

Electronic drum kits that are easily amplified are also available, and have been suggested to eliminate the amplification problem associated with acoustic kick drums. However, electronic drum kits are unpopular since they entirely eliminate the acoustical and tactile elements of the drums they replace. Drummers are sensitive to the feel of their drums, and depend on the tactile feedback from striking the resilient heads of the drums (whether with drumsticks or with a kick pedal). Electronic drum kits do not provide the feel that most drummers want or are accustomed to with their drums.

BRIEF SUMMARY OF THE INVENTION

The present invention is directed to a sound augmentation system for a drum having a wave generator for generating an electrical signal corresponding to a predetermined sound, an amplifier for amplifying the electrical signal from the wave generator, and a driver for translating the amplified electrical signal to sound waves. The wave generator, amplifier, and driver are co-located in close proximity, or attached to a support structure, so that they may be placed together within a drum body. The system provides compact, inexpensive sound augmentation for drums while retaining the traditional feel of the drum for the drummer.

In a first exemplary embodiment, the wave generator, amplifier, are attached to an enclosure formed by the driver, a rim, a support structure, and a rear panel. The enclosure is configured to fit within the body of a kick drum, thus the entire system may be placed as a unit within the drum body. A trigger circuit, such as a piezoelectric transducer, attached to the rear head of the drum detects a strike of the drum head, and generates a trigger signal which is transmitted to the wave generator. In response to the trigger signal, the wave generator produces an electrical signal corresponding to a user-selected, predetermined sound, e.g., a kick drum. The electrical signal is amplified by the amplifier and the amplified electrical signal is translated by a driver, such as a loudspeaker, into a plurality of sound waves. Thus, the system produces an amplified kick drum sound, emanating from the kick drum, to augment the acoustic sound of the drum.

In a second exemplary embodiment, the sound augmentation system includes an elongated hole formed through an upper area of the support structure to provide mechanical stabilization of the system within a drum body. A support rod, such as the support rod from a double tom holder extending through the top of the kick drum body, is inserted into the elongated hole. With the rod inserted into the elongated hole, the system is prevented from rolling or turning within the drum body.

In a third exemplary embodiment, the sound augmentation system includes a plurality of legs projecting outwardly from the support structure. The extending legs frictionally contact the inner surface of the kick drum body to support the system. The legs may be telescoping to allow adjustment and provide a secure fit against the drum body.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

The present invention will be described in greater detail in the following detailed description of the invention with reference to the accompanying drawings that form a part hereof, in which.

DETAILED DESCRIPTION OF EXEMPLARY EMBODIMENTS

Sound augmentation systems for a drum in accordance with various exemplary embodiments of the present invention are depicted in FIGS. 1 through 5. While the invention will be described in detail hereinbelow with reference to these exemplary embodiments, it should be understood that the invention is not limited to the specific configurations shown in these embodiments. Rather, one skilled in the art will appreciate that a variety of configurations may be implemented in accordance with the present invention.

Figure 1:
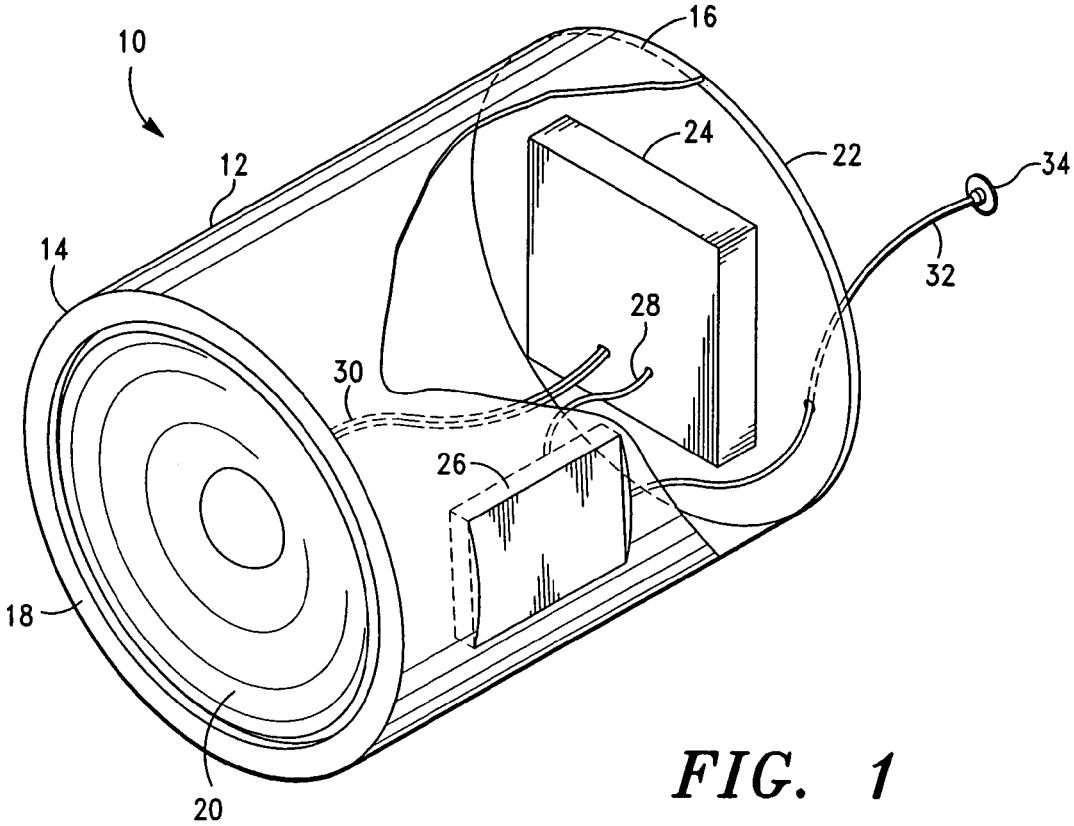
FIG. 1 is a cut-away, perspective view of a first exemplary embodiment of a sound augmentation system in accordance with the present invention.

Looking first to FIG. 1, a sound augmentation system for a drum in accordance with a first exemplary embodiment of the present invention is depicted generally by the designation 10. As can be seen, system 10 includes a tubular support structure or housing 12 that extends between an opening at first end 14 and an opening at second end 16. A circular rim 18 extends circumferentially around the opening at first end 14. A circular driver 20 (which will be described in greater detail hereinbelow) is affixed to rim 18 so as to substantially cover the entire opening at first end 14. Rim 18 may be integral to driver 20, or, rim 18 may be a separate piece that is sized to allow the use of drivers that are smaller than the diameter of the opening at first end 14. Rear panel 22 substantially covers the entire opening at second end 16 of support structure 12. Thus, an enclosure is formed by support structure 12, rim 18 and driver 20 (which cover the opening at first end 14), and rear panel 22 (which covers the opening at second end 16).

As will be described in greater detail hereinbelow, a wave generator 26 is mounted to the interior wall of support structure 12 within the enclosure. Also, an amplifier 24 is mounted to the interior wall of rear panel 22 within the enclosure. Thus, support structure 12, driver 20, wave generator 26 and amplifier 24 form a unitary system that may be moved from location to location, and, as described below with reference to FIGS. 2 and 3, located within the body of a drum.

It should be understood that the support structure may comprise any rigid chassis, frame, housing, or the like that is capable of supporting driver 20, wave generator 26 and amplifier 24 in close proximity to each other within a particular area, such as within the body of a drum. The support structure may also be the drum body itself. In the exemplary embodiment, support structure 12 comprises a rigid, solid-wall, cardboard, tubular housing having a diameter of approximately 18 inches and a length of approximately 15 inches. These dimensions allow support structure 12 to be placed within the body of most standard kick drums.

Similarly, rim 18 and rear panel 22 may be formed of any material that is capable of covering the openings of support structure 12. For example, in the exemplary embodiment, rim 18 and rear panel 22 are each formed of ¾ inch thick medium density fibreboard (MDF). Rim 18 and rear panel 22 may be attached to support structure 12 using screws, fasteners, adhesive, or other attachment mechanisms known in the art.

Of course, it should be understood that other configurations for the support structure are within the scope of the present invention. For example, the diameter and/or length of the support structure may be varied for particular applications or to fit within particular drums. Also, the support structure may be formed of different shapes, such as a square box, a rectangular box, or a series of shelves for supporting the components. The support structure may also be configured to support multiple drivers arranged in various configurations (such as front or down-firing drivers), or may be configured to support multiple amplifiers or multiple wave generators. Likewise, the arrangement of the components in relation to the support structure may vary. For example, wave generator 26 and amplifier 24 may be placed in different locations within the support structure, or, may be located apart from the support structure (either alone or mounted to a separate support structure). One skilled in the art will appreciate that a variety of other configurations for the support structure may be implemented in accordance with the present invention.

Looking still to FIG. 1, a trigger circuit 34 located outside of support structure 12 comprises an electrical or electronic circuit that is capable of detecting mechanical vibrations and generating an electrical trigger signal in response to the detection of such vibrations. Trigger circuit 34 may detect mechanical vibrations either by contacting the vibrating surface, or by being in proximity to the vibrating surface. For example, in the exemplary embodiment, trigger circuit 34 is a piezoelectric transducer (such as the Pulse KD-1 Acoustic Kick Drum Trigger). Of course, it should be understood that other types of trigger circuits may be also be used in accordance with the present invention.

Wave generator 26 comprises a sound generator or synthesizer module that is capable of producing an electrical signal corresponding to a predetermined sound, such as the sound of a drum, in response to a trigger signal originating from trigger circuit 34. Preferably, wave generator 26 uses digital signal processing (DSP) technology to produce the electrical signal, and has controls for allowing a user to select a predetermined sound, and controls to adjust the sensitivity of wave generator 26 to trigger circuit 34. For example, the Alesis DM5 High Sample Rate 18-Bit Drum Module has been found to be satisfactorily used for wave generator 26. The controls for wave generator 26 may be wired panel mount controls accessible on wave generator 26 or through rear panel 22, remotely located wired controls, or wireless controls using Bluetooth or other known wireless communication protocols or technologies. Of course, it should be understood that other types of wave generators may also be used in accordance with the present invention, such as analog or digital synthesizers, wave-table lookup sound generators, sampled sound players, and the like.

Amplifier 24 comprises a high-power, low-frequency audio amplifier that is capable of reproducing sounds in the frequency range of approximately 20 to 15,000 Hertz at a power level of approximately 150 Watts into an 8 ohm load. For example, in the exemplary embodiment, a panel amplifier (such as Parts Express Model #300-797 250 Watt PA Amplifier) is used to provide the necessary amplification. Of course, other configurations and types of amplifiers may also be used in accordance with the present invention. For instance, multiple amplifiers may be used to drive multiple drivers, or may be cascaded to drive a single driver. Controls for the amplifier may be of any type known in the art, including integral wired panel mount controls accessible through an opening in rear panel 22, remotely located wired controls, or wireless controls using Bluetooth or other known wireless communication protocols or technologies.

Driver 20 may comprise any driver capable of translating an amplified electrical signal to a plurality of sound waves, such as a loudspeaker or transducer. For example, in the exemplary embodiment, driver 20 is a 15 inch diameter woofer type loudspeaker that is capable of producing sound in the frequency range of approximately 40 to 3,500 Hertz. Preferably, driver 20 should be capable of handling power of at least 900 Watts peak and 450 Watts rms. For example, a Selenium model WPU1505 15 inch Pro Sound driver or equivalent may be used. It should be understood that other types of drivers may also be used in accordance with the present invention, such as multiple loudspeakers connected in series or in parallel, combinations of smaller diameter loudspeakers, down-firing loudspeakers, or combinations thereof. Other types of drivers, such as panel speakers, nano-technology speakers, line arrays, ribbon driver technology, and other driver technologies using multiple small drivers may also be used without varying from the scope of the present invention.

A trigger cable 32 extends from trigger circuit 34 (located outside of support structure 12) through an opening formed in rear panel 22 to wave generator 26. A signal cable 28 electrically couples wave generator 26 to amplifier 24, and a speaker cable 30 electrically couples amplifier 24 to driver 20. Trigger cable 32, signal cable 28 and speaker cable 30 may comprise any type of electrical cable capable of transmitting an electrical signal. For example, trigger cable 32 and signal cable 28 may be Monster Cable S-100 type cables having ¼ inch connectors at each end, which are configured to plug into ¼ inch receptacles on trigger circuit 34 and wave generator 26, respectively. Speaker cable 30 may be 16 gauge stranded wire, or any other wire capable of carrying the required power from amplifier 24 to driver 20 with minimal loss. Other cable and connector configurations, such as intermediate jacks, plugs, and extensions, will be apparent to those skilled in the art and may be used to interconnect the components of the system.

Figure 2:
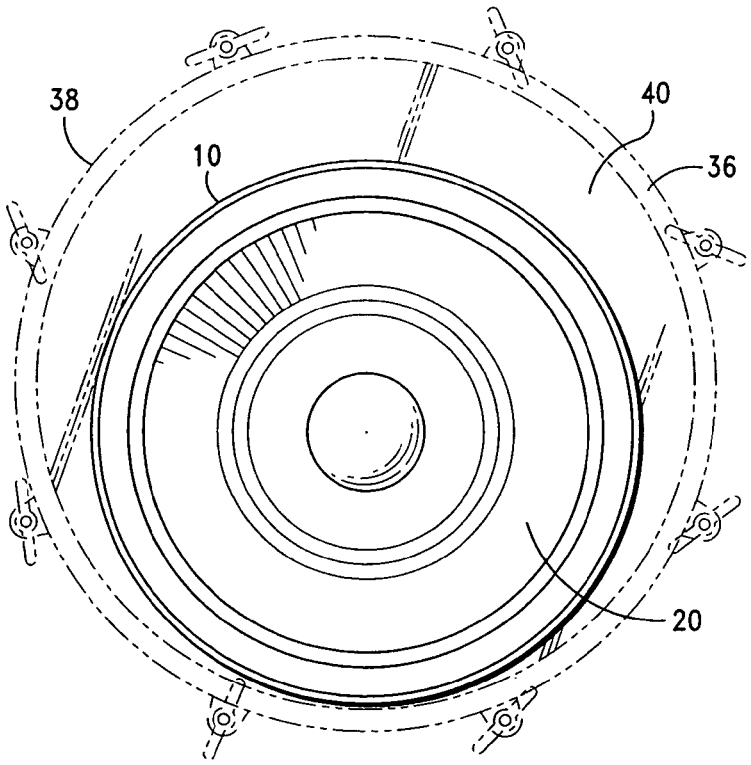
FIG. 2 is a front view of the sound augmentation system of FIG. 1, which has been located in the body of a kick drum.
Figure 3:
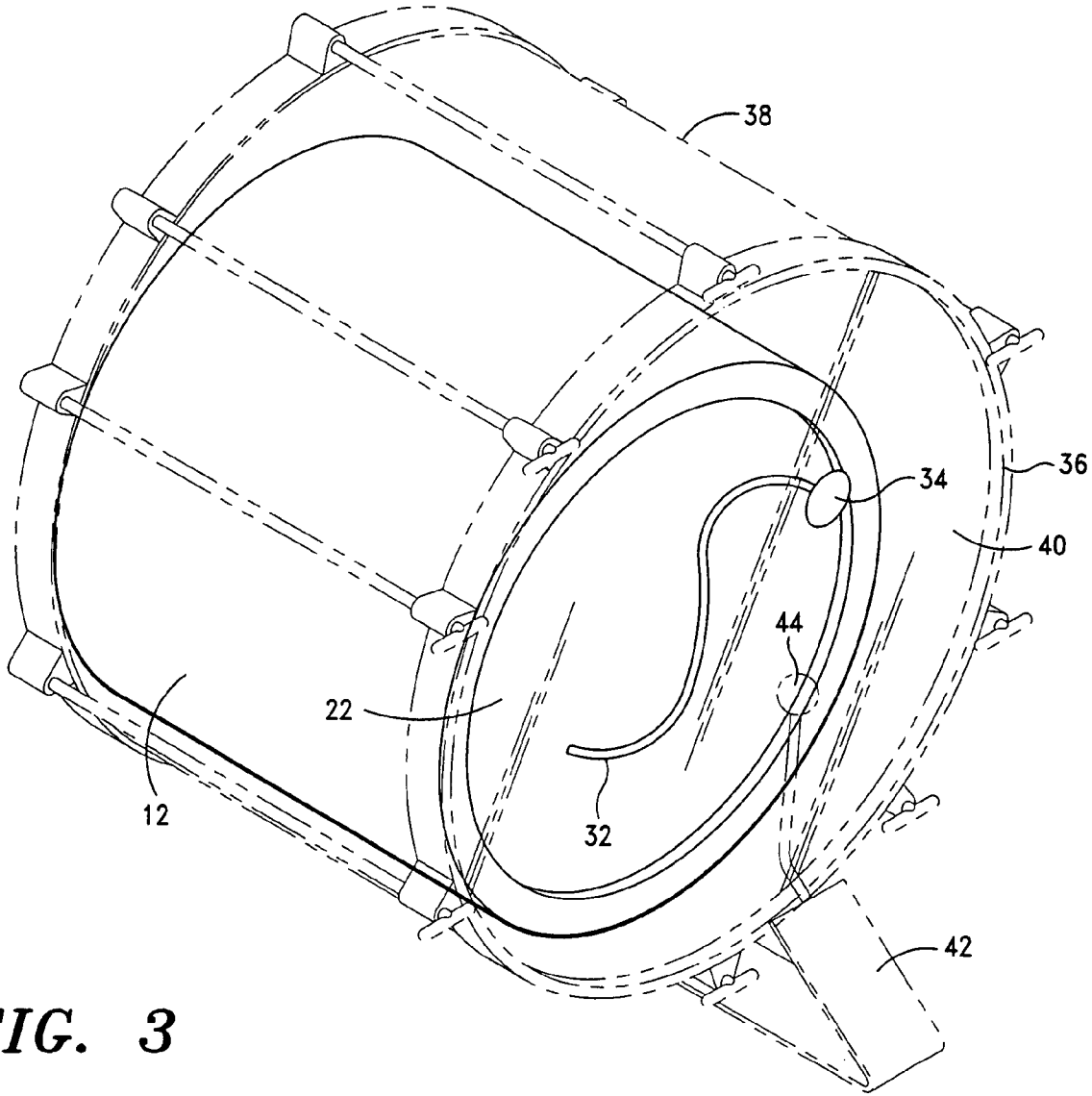
FIG. 3 is a rear perspective view of the sound augmentation system of FIG. 1, which has been located in the body of a kick drum.

Turning now to FIGS. 2 and 3, the entire system 10 may be placed inside the body 36 of a kick drum 38 to provide sound augmentation to the acoustic sounds that emanate from drum body 36. As shown in FIG. 2, with the front drum head removed, it can be seen that system 10 rests on the bottom of drum body 36, with driver 20 facing outwardly so as to direct the generated sound waves outwardly from kick drum 38. As shown in FIG. 3, trigger circuit 34 is attached to the interior wall of rear drum head 40 using adhesive, tape or other attachment mechanisms known in the art. Trigger cable 32 extends through an opening formed in rear panel 22 so as to electrically couple trigger circuit 34 to wave generator 26 (which can be seen in FIG. 1). Of course, other types of configurations and connections will be apparent to those skilled in the art. For example, trigger circuit 34 may be located at other positions on the interior wall of rear drum head 40, or may be located on the exterior wall of rear drum head 40. Also, trigger circuit 34 may be located in non-contact, close proximity to rear drum head 40 so as to be capable of detecting the mechanical vibration of rear drum head 40. Of course, it should be understood that power for the various components of system 10 may be provided by a power cord connected to a power mains, batteries within the unit, or any other power source known in the art.

Referring now to FIGS. 1-3, in operation, a kick pedal 42 is linked to a beater 44 such that a drummer stepping on kick pedal 42 causes beater 44 to strike rear drum head 40, which in turn causes rear drum head 40 to vibrate and produce sound waves. The resiliency of rear drum head 40 provides tactile feedback through beater 44 and kick pedal 42 to the drummer, allowing him or her to feel the striking of the drum. Trigger circuit 34 detects the mechanical vibration of rear drum head 40 and generates an electrical trigger signal that is transmitted to wave generator 26 through trigger cable 32.

In response to the trigger signal, wave generator 26 produces an electrical signal corresponding to a predetermined sound (e.g., the user-selected sound of a kick drum). The electrical signal from wave generator 26 is transmitted over signal cable 28 to amplifier 24. Amplifier 24 amplifies the electrical signal received from wave generator 26 to a high power amplified electrical signal which is transmitted to driver 20 over speaker cable 30. Driver 20 converts the amplified electrical signal to a plurality of sound waves that emanate outwardly from system 10.

Thus, system 10 augments the acoustic sound produced by striking rear drum head 40 with an amplified sound emanating from within kick drum 30. With system 10 compactly located in drum body 36, the system takes no additional space on the stage since the system is contained within a conventional kick drum. In addition, system 10 is less expensive and more wieldy than remote microphone/amplifier/speaker configurations. Furthermore, system 10 retains the conventional rear drum head and kick pedal so that the drummer notices no difference in the feel or performance of the drum.

Further variations and configurations of the sound augmentation system are contemplated by the present invention. For example, support structure 12 may include a carrying handle for easily transporting the system. The system may include ports through rim 18, rear panel 22, or support structure 12 to allow the frequency response of the formed enclosure to be tuned to a particular driver. In addition, the system may include various preamplifiers, filters, signal processors, or the like in the electrical stream between the wave generator and the driver. The system may also include a protective mesh grille or shield over the driver. Further, the system may include a visually opaque or translucent, but acoustically transparent, cloth or grille configured to cover the entire front of drum body 36 in order to conceal the system within the drum. In commercial use, the cloth or grille may further be imprinted with a logo or advertising message.

Figure 4:
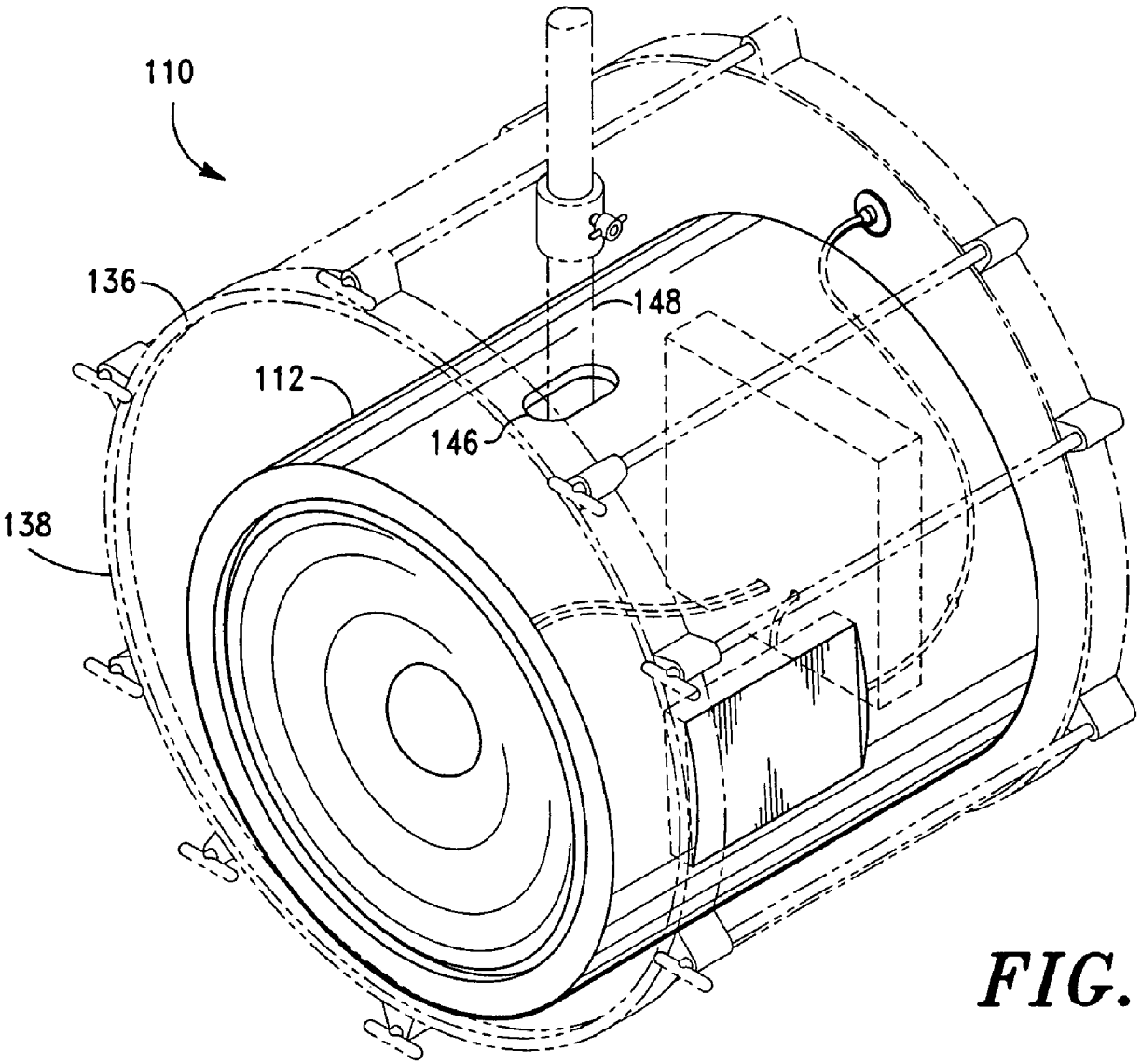
FIG. 4 is a perspective view of a second exemplary embodiment of a sound augmentation system in accordance with the present invention which has been located in the body of a kick drum.

Looking now to FIG. 4, a sound augmentation system for a drum in accordance with a second exemplary embodiment of the present invention is depicted generally by the designation 110. System 110 has the same configuration as system 10 described hereinabove with reference to FIGS. 1-3, including a support structure 112. In addition, system 110 includes an elongated hole 146 through the top of support structure 112 to receive a support rod to mechanically stabilize system 110 within a drum body 136. Elongated hole 146 is configured to receive a support rod 148, such as the support rod of a double tom holder mounted through a locking collar on the top of a kick drum. Support rod 148 extends downwardly through the top of the kick drum 138 and into elongated hole 146 to prevent system 110 from rolling or rotating within drum body 136. Elongated hole 146 may include a flexible or rigid sleeve or flap to seal around support rod 148, or may be open to form an acoustic or tuning port within support structure 112. Additional stabilization hardware, such as locking collars or cams, or other hardware known in the art, may be used to secure support rod 148 within elongated hole 146 to provide mechanical stabilization of the system.

Figure 5:
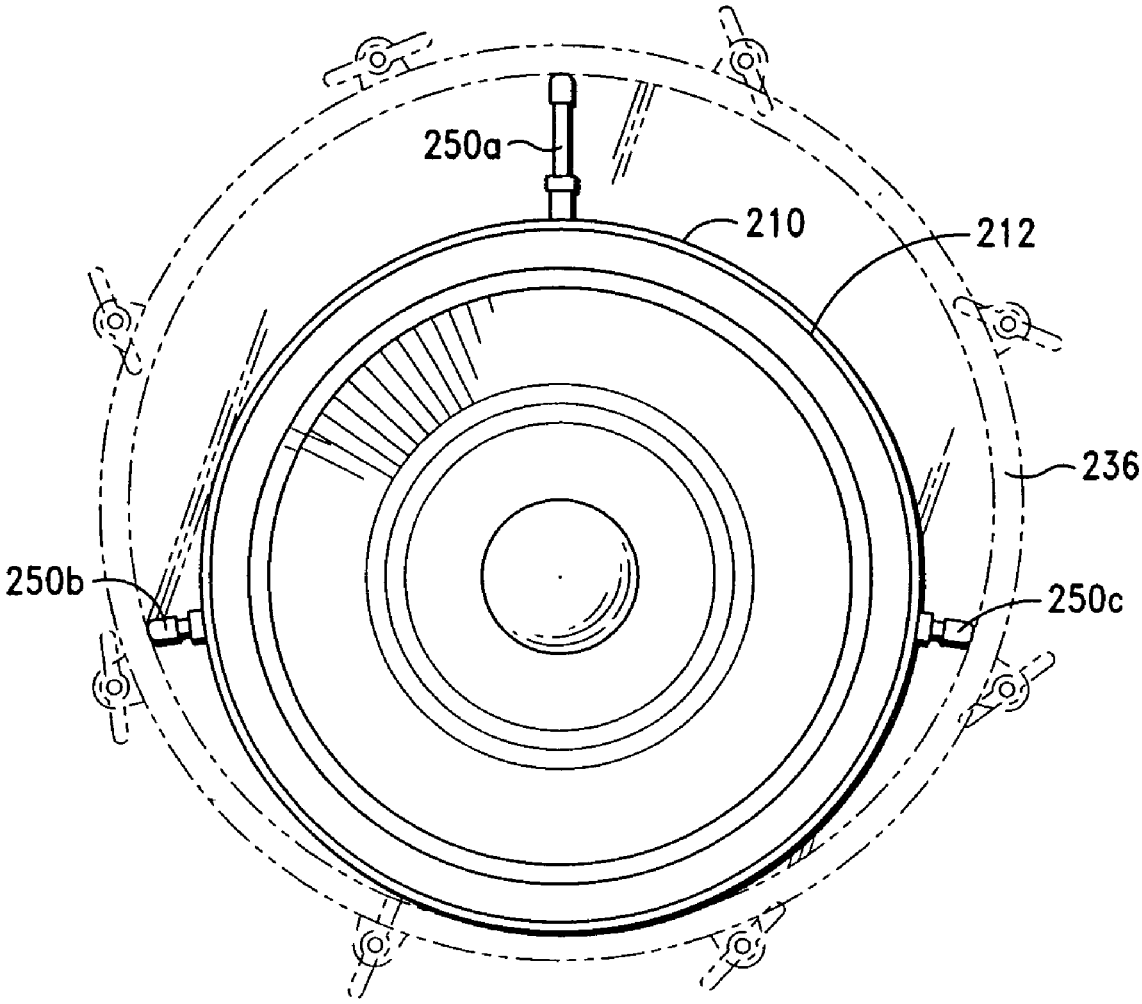
FIG. 5 is a front view of a third exemplary embodiment of a sound augmentation system in accordance with the present invention which has been located in the body of a kick drum.

Turning to FIG. 5, a sound augmentation system for a drum in accordance with a third exemplary embodiment of the present invention is depicted generally by the designation 210. System 210 has the same configuration as system 10 described hereinabove with reference to FIGS. 1-3, including a support structure 212. In addition, system 210 includes one or more legs 250*a*, 250*b*, 250*c* extending outwardly from support structure 212 to mechanically stabilize system 210 within drum body 236. Legs 250*a*, 250*b*, 250*c* may be fixed length configured to fit a specific drum, or may be telescopic or spring loaded to provide frictional engagement of legs 250*a*, 250*b*, 250*c* with the interior wall of drum body 236 to thereby hold system 210 in place within drum body 236.

As can be seen, the invention described herein provides a system for augmenting the sound of a drum that does not alter the acoustical and tactile elements of a drum, that is compact such that it may be placed within a drum body, and that is less expensive and occupies less space than large venue amplifiers and speakers. Of course, other embodiments or configurations will be apparent to those skilled in the art, and are contemplated by and within the scope of the present invention.

The term "substantially" or "approximately" as used herein may be applied to modify any quantitative representation which could permissibly vary without resulting in a change in the basic function to which it is related. For example, the tubular support structure 12 of FIG. 1 is described as being "approximately" 18 inches in diameter, but may permissibly vary from that dimension if the variance does not materially alter the capability of the invention.

While the present invention has been described and illustrated hereinabove with reference to various exemplary embodiments, it should be understood that various modifications could be made to these embodiments without departing from the scope of the invention. Therefore, the invention is not to be limited to the exemplary embodiments described and illustrated hereinabove, except insofar as such limitations are included in the following claims.

What is claimed and desired to be secured by Letters Patent is as follows:

1. A sound augmentation system for a drum, comprising:

a wave generator for generating an electrical signal corresponding to a predetermined sound;

an amplifier in electrical communication with said wave generator for amplifying said electrical signal to produce an amplified electrical signal;

a driver in electrical communication with said amplifier for translating said amplified electrical signal to a plurality of sound waves; and a support structure within a body of said drum, configured to support said wave generator, said amplifier and said driver within said body of said drum.

2. The sound augmentation system of claim 1, further comprising a trigger circuit for activating said wave generator.

3. The sound augmentation system of claim 2, wherein said trigger circuit is affixed to a head of said drum such that a strike of said head of said drum activates said trigger circuit.

4. The sound augmentation system of claim 2, wherein said trigger circuit comprises a piezoelectric transducer.

5. The sound augmentation system of claim 1, wherein said predetermined sound is generated in response to a strike of a head of said drum.

6. The sound augmentation system of claim 1, wherein said driver comprises a loudspeaker.

7. The sound augmentation system of claim 1, wherein said support structure comprises a housing.

8. The sound augmentation system of claim 7, wherein said driver is mounted within an opening of said housing.

9. The sound augmentation system of claim 8, wherein said wave generator and said amplifier are each mounted to an interior wall of said housing.

10. The sound augmentation system of claim 1, further comprising a stabilizing mechanism configured to secure said support structure within said body of said drum.

11. The sound augmentation system of claim 10, wherein said stabilizing mechanism comprises an elongated hole formed in said support structure and configured to receive a support rod that extends through said body of said drum.

12. The sound augmentation system of claim 10, wherein said stabilizing mechanism comprises at least one leg extending outwardly from said support structure for frictional engagement with said body of said drum.

13. A sound augmentation system for a drum, comprising a wave generator for generating an electrical signal corresponding to a predetermined sound;

an amplifier in electrical communication with said wave generator for amplifying said electrical signal to produce an amplified electrical signal;

a driver in electrical communication with said amplifier for translating said amplified electrical signal to a plurality of sound waves; and wherein said driver, said wave generator and said amplifier are configured to be co-located within a body of said drum.

14. The sound augmentation system of claim 13, further comprising a trigger circuit for activating said wave generator in response to a strike of a head of said drum.

15. The sound augmentation system of claim 14, wherein said trigger circuit comprises a piezoelectric transducer.

16. The sound augmentation system of claim 13, wherein said predetermined sound is generated in response to a strike of a head of said drum.

17. The sound augmentation system of claim 13, wherein said driver comprises a plurality of drivers.

18. A sound augmentation system for a drum, comprising:

a trigger circuit for detecting a strike of a head of said drum;

a wave generator in electrical communication with said trigger circuit for generating an electrical signal corresponding to a predetermined sound in response to said detection of said strike of said head of said drum;

an amplifier in electrical communication with said wave generator for amplifying said electrical signal to produce an amplified electrical signal;

a driver in electrical communication with said amplifier for translating said amplified electrical signal to a plurality of sound waves; and a housing configured to fit within a body of said drum, wherein said wave generator, said amplifier and said driver are mounted to said housing such that said housing, said wave generator, said amplifier and said driver are located as a unit within said body of said drum.

19. The sound augmentation system of claim 18, wherein said trigger circuit is affixed to said head of said drum.

20. The sound augmentation system of claim 18, wherein said driver is mounted within an opening of said housing.

21. The sound augmentation system of claim 20, wherein said wave generator and said amplifier are each mounted to an interior wall of said housing.

22. The sound augmentation system of claim 18, further comprising a stabilizing mechanism configured to secure said housing within said body of said drum.

23. The sound augmentation system of claim 22, wherein said stabilizing mechanism comprises an elongated hole formed in said housing and configured to receive a support rod that extends through said body of said drum.

24. The sound augmentation system of claim 22, wherein said stabilizing mechanism comprises at least one leg extending outwardly from said housing for frictional engagement with said body of said drum.

25. A method of augmenting the sound of a drum, comprising:

providing a trigger circuit adjacent a head of said drum;

providing a wave generator located within a body of said drum, wherein said trigger circuit and said wave generator are in electrical communication;

providing an amplifier located within said body of said drum, wherein said wave generator and said amplifier are in electrical communication;

providing a driver located within a body of said drum, wherein said amplifier and said driver are in electrical communication;

detecting a strike of said head of said drum with said trigger circuit; and transmitting an electrical signal from said trigger circuit to said driver in response to said detection of said strike.

26. The method of claim 25, wherein said driver is operable to translate said amplified electrical signal to a plurality of sound waves.

27. The method of claim 25, further comprising:

generating an electrical signal in response to said detection of said strike of said head of said drum; and amplifying said electrical signal to produce said amplified electrical signal.

28. The method of claim 27, wherein said generation of said electrical signal is performed by said wave generator.

29. The method of claim 27, wherein said amplification of said electrical signal is performed by said amplifier.

30. A drum having a sound augmentation system, comprising:

a trigger circuit adjacent a head of said drum for detecting a strike of said head of said drum;

a wave generator in electrical communication with said trigger circuit for generating an electrical signal in response to said detection of said strike;

an amplifier in electrical communication with said wave generator for amplifying said electrical signal;

a driver in electrical communication with said amplifier for translating said amplified electrical signal to a plurality of sound waves; and a drum body configured to support said driver, said wave generator and said amplifier within said body.

31. The drum of claim 30, further comprising:

a drum head; and a trigger circuit operably coupled to said drum head.

* * * * *